US005943936A

United States Patent [19]

Deliman et al.

[11] Patent Number: 5,943,936

[45] Date of Patent: Aug. 31, 1999

[54] WHEELED LUGGAGE CASE WITH EXTENDABLE HANDLE

[75] Inventors: Lawrence J. Deliman, Aurora; Daniel G. Elles, Conifer; David W. Fiddes, Brighton; James S. Gregg, Aurora, all of Colo.; Rik Hillaert, Oudenaarde, Belgium; William L. King, Denver, Colo.; Jon C. Nordmark, Highlands Ranch, Colo.; Roger Pedlar, Golden, Colo.; Robert M. Tesman, Littleton, Colo.; Carlo F. Zezza, Denver, Colo.

[73] Assignee: Samsonite Corporation, Denver, Colo.

[21] Appl. No.: 08/813,220

[22] Filed: Mar. 7, 1997

Related U.S. Application Data

[60] Provisional application No. 60/013,059, Mar. 8, 1996.

[51] Int. Cl.[6] ..... A45C 5/14; A45C 13/22; A45C 13/28

[52] U.S. Cl. ..... 90/115; 190/18 A; 190/39; 16/115

[58] Field of Search ..... 190/18 A, 39, 190/115, 117; 16/115

[56] References Cited

U.S. PATENT DOCUMENTS

| | | | |
|---|---|---|---|
| 1,658,174 | 2/1928 | Russell | 190/117 |
| 2,392,926 | 1/1946 | Kelly | 190/115 |
| 3,895,696 | 7/1975 | Urushibara | 190/18 A X |
| 4,759,431 | 7/1988 | King et al. | 190/18 A |
| 5,048,649 | 9/1991 | Carpenter et al. | 190/18 A |
| 5,114,164 | 5/1992 | Bothwell et al. | 190/18 A X |
| 5,253,739 | 10/1993 | King | 190/115 X |
| 5,355,980 | 10/1994 | Hsieh | 190/115 |
| 5,407,040 | 4/1995 | Hu | 16/115 X |
| 5,431,262 | 7/1995 | Rekuc et al. | 190/115 X |
| 5,488,756 | 2/1996 | Hsieh | 190/18 A X |
| 5,531,300 | 7/1996 | Tsai | 190/18 A X |
| 5,560,458 | 10/1996 | Franklin et al. | 190/39 X |
| 5,566,797 | 10/1996 | Van Himbeeck | 190/39 X |
| 5,581,847 | 12/1996 | Hsieh | 190/39 X |
| 5,588,513 | 12/1996 | Lin | 190/115 |
| 5,590,748 | 1/1997 | Chang | 190/18 A |
| 5,630,521 | 5/1997 | Waddell et al. | 190/18 A |

*Primary Examiner*—Sue A. Weaver
*Attorney, Agent, or Firm*—Gregory W. O'Connor

[57] ABSTRACT

Wheeled luggage cases include at least two wheels and a handle with which to roll the luggage on these wheels. Most prior art wheel handles require the user to use considerable force to balance the case on these two wheels, either when the case is carrying auxiliary cases or when otherwise fully loaded. The disclosed luggage case has a wheel handle which extends out of and along one side of the case on an arm, and a handle grip mounted on this arm in a way that tips the luggage case forward to better balance over the wheels when carrying varying loads. The wheel handle arm also includes a mechanism that supports the handle grip at different heights to further optimize this load balancing function.

9 Claims, 9 Drawing Sheets

WHEELED LUGGAGE CASE WITH EXTENDABLE HANDLE

This application claims the benefit of U.S. Provisional Application No. 60,013,059 filing date Mar. 8, 1996.

BACKGROUND OF THE INVENTION

This invention relates to wheeled luggage cases and, more particularly, to those luggage cases that have their wheels (usually two) mounted along the broad longitudinal edge at the bottom of the luggage case, and a handle used to steer the case on these wheels mounted on the upper end of the case. Usually this handle is mounted next to the broad edge at the top of the case and on the same broad side of the case as the wheels. More particularly, this invention is related to such wheeled luggage cases having hooks, straps and the like for carrying an auxiliary luggage case.

An example of this prior type of luggage case is shown in U.S. Pat. No. 4,759,431 (a 16 page copy is incorporated by reference) assigned to Samsonite Corporation, assignee of the subject invention. In this patent, such a luggage case is shown with the steering handle, sometimes called the wheel handle, mounted on a stalk or arm. This arm can be extended to a convenient height for the user to wheel the case on the wheels by tipping the case forward onto the wheels. The arm can be lowered into a cavity or receiver mounted on one face or wall of the luggage case for convenient storage or shipping. This type of luggage case is remarkably stable because the lever arm provided by the wheel handle helps steady the case. Leverage is especially desirable when the case carries other auxiliary cases by using the strap normally stored in the wheel handle.

As discussed in great detail in the above-mentioned U.S. patent, such luggage cases can carry a remarkable amount of luggage and move this luggage along a horizontal surface. When extended the handle arm ideally should position the handle at a comfortable distance above the floor for the user when the case is tipped forward. We have found that the angle to which this case is tipped at an angle to the horizontal depends on how heavily the luggage case is loaded and on whether that luggage case is carrying heavily loaded auxiliary cases. At an ideal angle, the case and handle system will balance on the wheels with only minor vertical support provided at the wheel handle by the user So, the hand grip height (that distance from the floor to the handle grip when in the wheeling position) should be such that the case almost balances on the wheels while it is being towed, with the user providing a small amount of upward force during the pulling. This would place the ideal angle for towing at about five degrees below the point where the case (or the case and the auxiliary cases attached thereto) is perfectly balanced. This ideal balancing angle (or five degrees below the balancing angle for reasonably comfortable towing) decreases as the load provided by the auxiliary case increases. Because of this, the handle height from the floor becomes a function of the luggage carried and less a function of the comfortable height for the user. The worst case would be to have the tallest person (with a comfortable hand grip height greatest from the floor) towing the heaviest load, that is, a heavily loaded main packing case with heavily loaded auxiliary cases attached. The prior art systems demand that, in this situation, this tall user would lower his or her hand to an unnatural and uncomfortable position to maintain the heavily loaded and burdened luggage case in a more or less balanced position.

An opposite phenomenon exists when a relatively short user (who would presumably have the shortest comfortable hand grip height) is towing a heavily loaded main case, but no auxiliary cases. Thus, there would not be a mass of weight positioned on the trailing side of the wheels to counterbalance the weight of the main packing case. While the user could maintain a towing balance, the user would tend to become more fatigued because a greater net amount of weight is being carried by the user via the wheel handle.

Also, in most prior art wheel handle systems, the height to which the handle can extend is usually limited to the vertical dimension of a wall of the luggage case into which the wheel handle and handle grip can be stored. Generally, one would like to have as long a wheel handle as reasonably possible. A long wheel handle, all other things being equal, provides the greatest leverage for supporting and balancing a luggage load. Also, a long arm helps distance the wheeled case from the user's feet so that the user may stride vigorously without hitting the towed case with the user's heels. One solution to this problem is to construct the wheel handle arm of two or more telescoping sections to reduce its stored height. Another solution is to make the vertical dimension of the luggage case, and thus the vertical dimension of the wall storing the wheel handle arm, much greater than that of a typical luggage case.

OBJECTS OF THE INVENTION

Accordingly, it is an object of the instant invention to provide a wheel handle and support mechanism to better adapt to the varying heights (and thus varying carrying angles) of the users as well as the varying loading scenarios illustrated above.

It is another object of this invention to provide a wheel handle which integrates aesthetically and functionally into a carry handle normally positioned on the upper face of the luggage case at about the geometric center for ordinary carrying (rather than wheeling on the wheels).

It is another object of the invention to simplify the construction of the wheel handle while still providing for user comfort and versatility of the transport system common to all such wheeled luggage cases.

SUMMARY OF THE INVENTION

Accordingly, the instant invention provides for a wheeled luggage case (either molded from plastic materials or from cloth fabric and ordinary frame materials) which includes a wheel handle. This wheel handle is mounted on an arm that is normally contained adjacent to one wall of the luggage case. This wheel handle arm includes a latching means that permits the user to lock the arm in the position adjacent to the wall of the case and permits the user to selectively withdraw the arm to place the wheel handle in a position to tow the case. This latch means also permits the user to select at least two alternate positions for the steering handle for towing; the first position being closer to the luggage case, and the second position being farther away from the luggage case. In this way, the length of the wheel handle and thus, the height at which the wheel handle can be placed and yet still balance the load carried by the luggage case, can be selected depending on how the luggage case is loaded, and the optimum height for gripping the wheel handle by the user.

Also, the subject invention provides a wheeled luggage case having a main packing compartment of generally parallelopiped shape with the main front and back walls angling substantially toward one another from a base portion to a top portion. The top portion includes a carry handle for carrying the luggage case. One of the walls includes a slot, groove, or other receiver for mounting a wheel handle arm in a manner such that the wheel handle arm can be stored adjacent to one of the angled walls and also, may be withdrawn from this adjacent relationship with the wall of the case to present the wheel handle arm such that it extends above and over the top of the case at a substantial angle. The wheel handle arm has attached to its upper end the wheel handle grip. This wheel handle grip is generally a loop-shaped construction that, in turn, is mounted at a substantial angle to the top of the wheel handle arm such that the most remote end of this loop is positioned so that the wheel handle grip and the carry handle nest in one another when the wheel handle arm is in a position adjacent the angled wall of the case. When the wheel handle arm is in a second position such that at least a portion of the wheel handle arm is withdrawn from its adjacent position along the wall of the case, the wheel handle extends toward the other of the two angled walls.

Also, the subject invention provides a wheel handle arm of substantially a one-piece construction. On this wheel handle is a generally rectangular cross-section member that includes at least one cam surface on one face thereof. This cam surface includes at least one channel to receive a protrusion. This position of this protrusion is controlled by a latch. The channel in the cam surface includes at least a first surface that engages the protrusion on the latch such that the pull handle arm is blocked from moving from its position adjacent the angled case wall; a second surface that engages the protrusion on the latch means such that the wheel handle arm can be withdrawn from its adjacent position; and at least a third surface that engages the protrusion such that the wheel handle arm is locked into a position only partly withdrawn from its adjacent position with the case wall.

DETAILED DESCRIPTION OF THE PREFERRED EMBODIMENT

Figure 1:
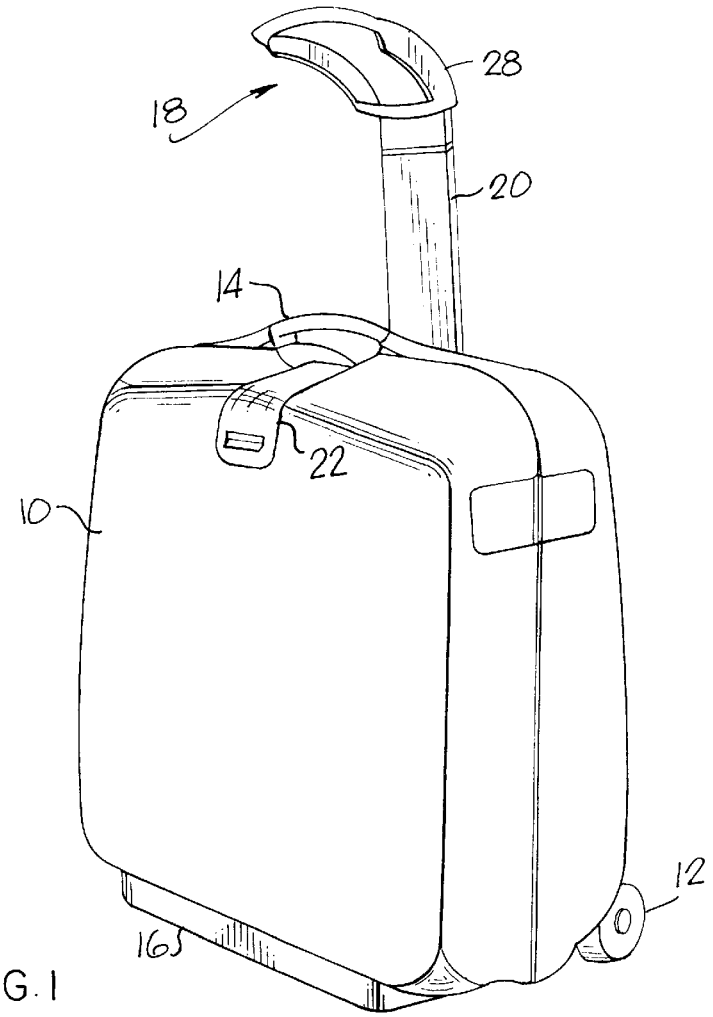
FIG. 1 is a perspective view of a preferred luggage case according to the instant invention.

Referring to the Figures, the overall luggage case 10 according to the preferred embodiment is molded thermoplastic, preferably polypropylene, and includes wheels 12 (one shown next to the lower broad edge of the case). An integrally molded glide or leg 16 is shown along the opposite edge of the lower face. This permits the luggage case 10 to stand erect when it is not been wheeled on its wheels. The case also includes a carry handle 14 fixed to the top center of the case. A loop shaped wheel handle grip 18 is attached to the upper end of a wheel handle arm 20. The arm is shown in an extended position, with most of the arm extending up from the back wall of the case to position the grip well above the luggage case 10 itself. On the wall of the luggage case 10 opposite from that bearing the wheel handle arm is a reel cassette 22 to receive and deploy a strap with a luggage handle engaging hook attached to its end. The device functions to selectively attach auxiliary luggage cases as set forth in U.S. Pat. No. 4,759,431. Details of its construction and operation are set forth in copending U.S. patent application Ser. No. 08/481,961 filed on Jun. 7, 1995, entitled "RETRACTABLE AUXILIARY LUGGAGE CASE ATTACHMENT AND SECURITY TETHER MECHANISM AND METHOD," assigned to Samsonite Corporation, which disclosure is incorporated herein.

Figure 2:
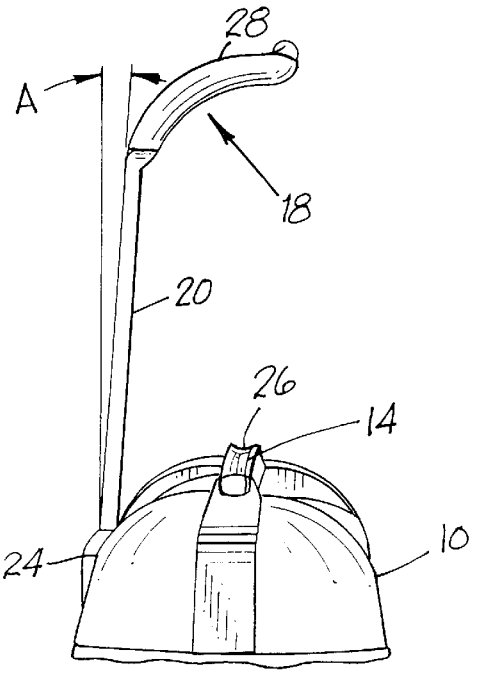
FIG. 2 is a partial view of the luggage case of FIG. 1 shown from the side.

FIG. 2 shows a side view of the luggage case 10 as seen from the side opposite from that shown in FIG. 1. An upper portion of the angled wall 24 from which the handle arm has been extended can now be seen. The handle arm extends at an angle A from the vertical that is about the same as the angle from vertical presented by the angled wall from which it extends. This angle, together with the curving extension 28 of the wheel handle loop which extends at a further angle from the arm 20, has positioned the grip well above and toward the opposite side of the luggage case 10. The benefits of this geometry will be explained below.

Figure 3:
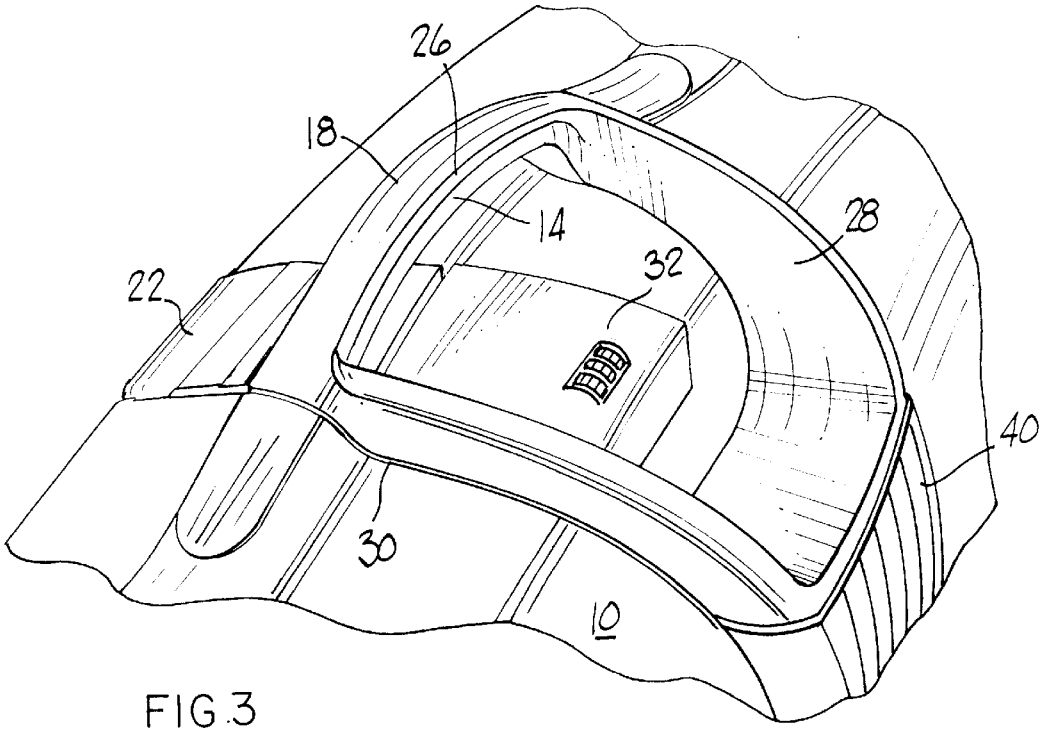
FIG. 3 is a detail view of the luggage case with its wheel handle in the fully lowered position.

As can be seen in FIG. 3, when the wheel handle is in its lowered position with the wheel handle arm adjacent the one wall of the case, the wheel handle nests within the concave upper surface 26 of the carry handle 14, forming a relatively comfortable single handle when in this carrying position. The curving extensions 28 of the handle loop 18 follow the curving top of the molded shell of the case, and preferably fit in a molded notch or indentation 30 along the adjacent portion of the case shell. A latching lock 32 for securely closing the shells of the luggage sits below both handles, protected by the handle structures from direct impacts. Immediately below the handle loop is a molded skid plate 40, preferably injection molded of ABS thermoplastic. This is fastened to the angled case wall into an elongated flat walled notch 34 to form a pocket or slot into which the handle arm 20 is normally stored.

Figure 4:
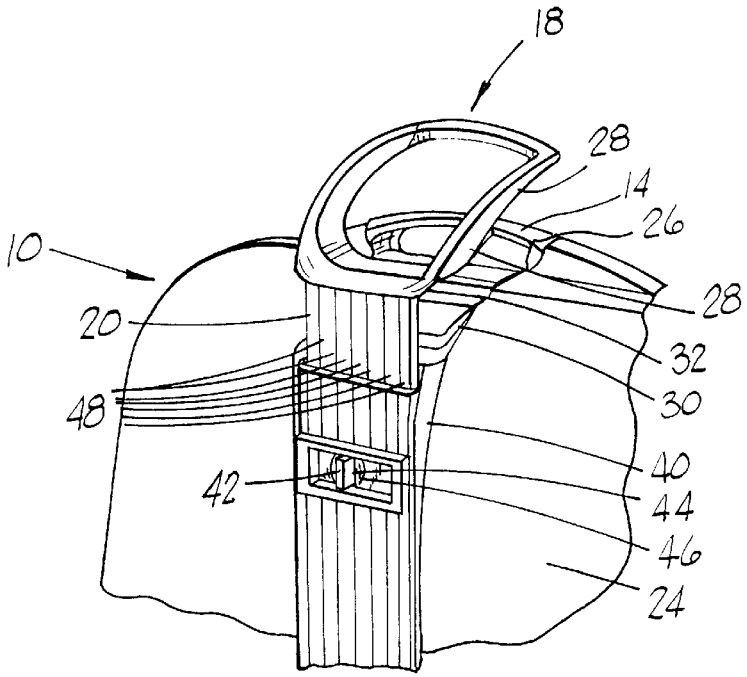
FIG. 4 shows the operation of the wheel handle.

FIG. 4 shows the wheel handle being partially withdrawn from the stored position shown in FIG. 3. In the preferred embodiment, the arm and handle assembly would be supported in this position by a biasing spring 84, as will be explained. The user can operate a slide latch 44 via a small projection 46 that extends through a rectangular aperture 42 in the skid plate 40. The arm includes a series of generally vertically protruding fins or walls 48 integrally molded into a generally flat, broad surface of the substantially monolithic, one piece injection molded wheel arm 20. As will be set forth, the other side of the slide latch includes one or more protrusions 50 that engage the lateral surfaces of these walls, using them as cam surfaces to thus control the positions of the arm relative to the skid plate 40, and thus relative to the luggage case 10. The concave upper surface 26 of the carry handle 14 can be seen in this figure, as the wheel handle grip has moved up and out from engagement therewith.

The geometry provided by the sloping wall of the case (which controls the sloping angle of the groove into which the handle arm extends) and the handle arm itself, with its extremely offset handle grip 18, will now be discussed.

Figure 5B:
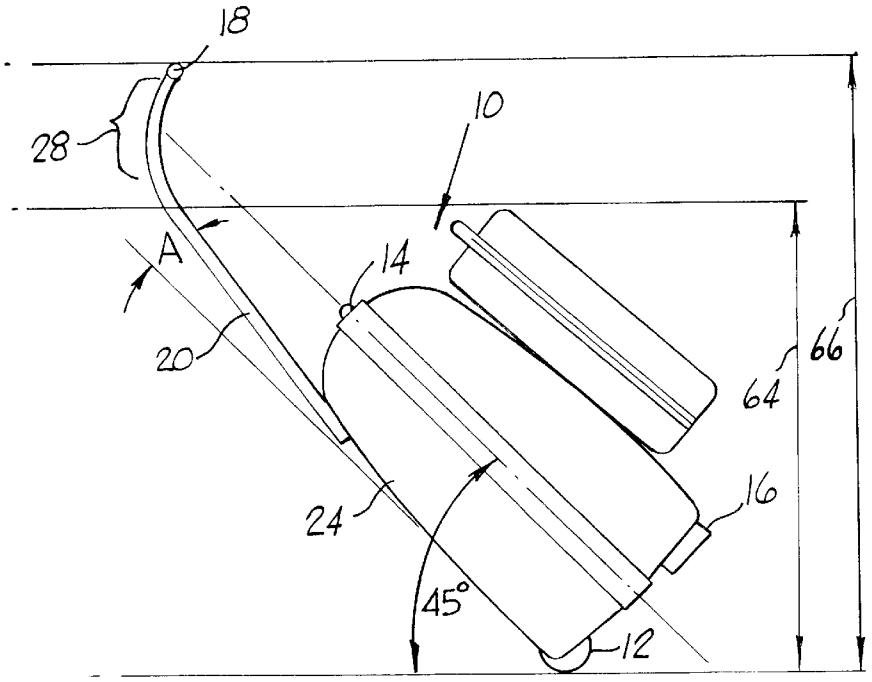
FIGS. 5A and 5B compare a prior art upright case to the preferred embodiment.
Figure 5A:
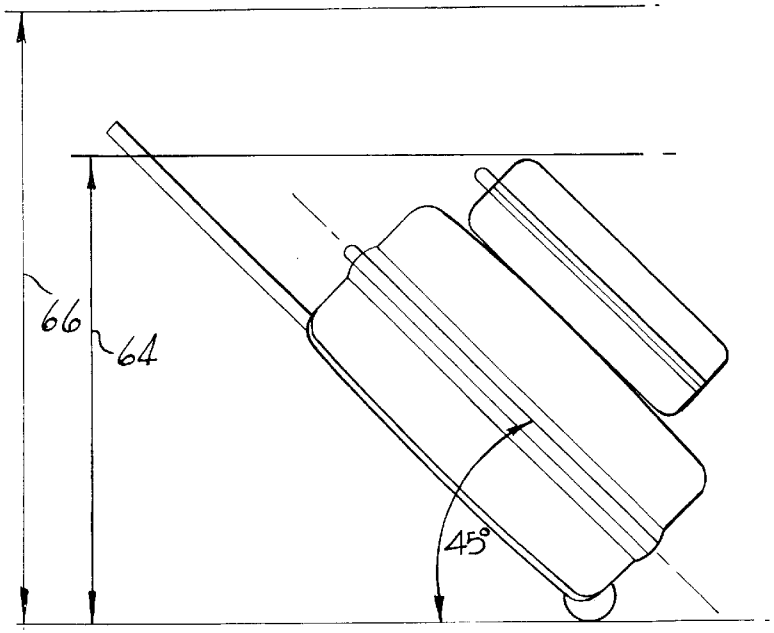
FIG. 5A (PRIOR ART)

FIG. 5A shows a more conventional luggage case of the type shown the previously-mentioned U.S. patent. There, the wheel handle on its arm extends directly up from the generally vertical wall of the luggage case. At an assumed balancing angle of 45 degrees (the angle at which the case and its auxiliary case will presumably balance), the grip of the wheel handle would be positioned at distance 64 above the ground. For many people, this is too low for comfort, requiring the user to stoop to maintain this relatively low angle and thus balance the loaded case.

FIG. 5B shows the wheel handle in an extended position. Note that because the wall 24 of the luggage case 10 and the wheel handle receiving notch 34(see FIGS. 6 and 7) is at a substantial angle to the vertical (shown as angle "A" in FIGS. 2 and 5B,) the wheel handle continues this non-vertical angle, carrying with it the loop handle grip 18 well over the top of the case toward the opposite wall of the case. This places the wheel handle in a position such that when the case is wheeled on the wheels 12, the case can be leaned well forward to allow balancing the case and the attached auxiliary case on the wheels 12 while still maintaining the wheel handle in a comfortable height above the ground. Thus, the wheel handle arm itself extends at a substantial angle (between about 3 and 15 degrees) to the vertical (when the case is resting on wheels 12 and glides 16) axis of the case. The extension portion 28 of the wheel handle is in turn mounted to the wheel handle arm at a substantial angle. Thus, the resulting position of the handle grip is more in keeping with the ideal height for the user, placing the wheel handle at a much greater distance 66 from the ground. For the preferred case, this distance is about 850 millimeters from the ground, a better position for most users.

Figure 6:
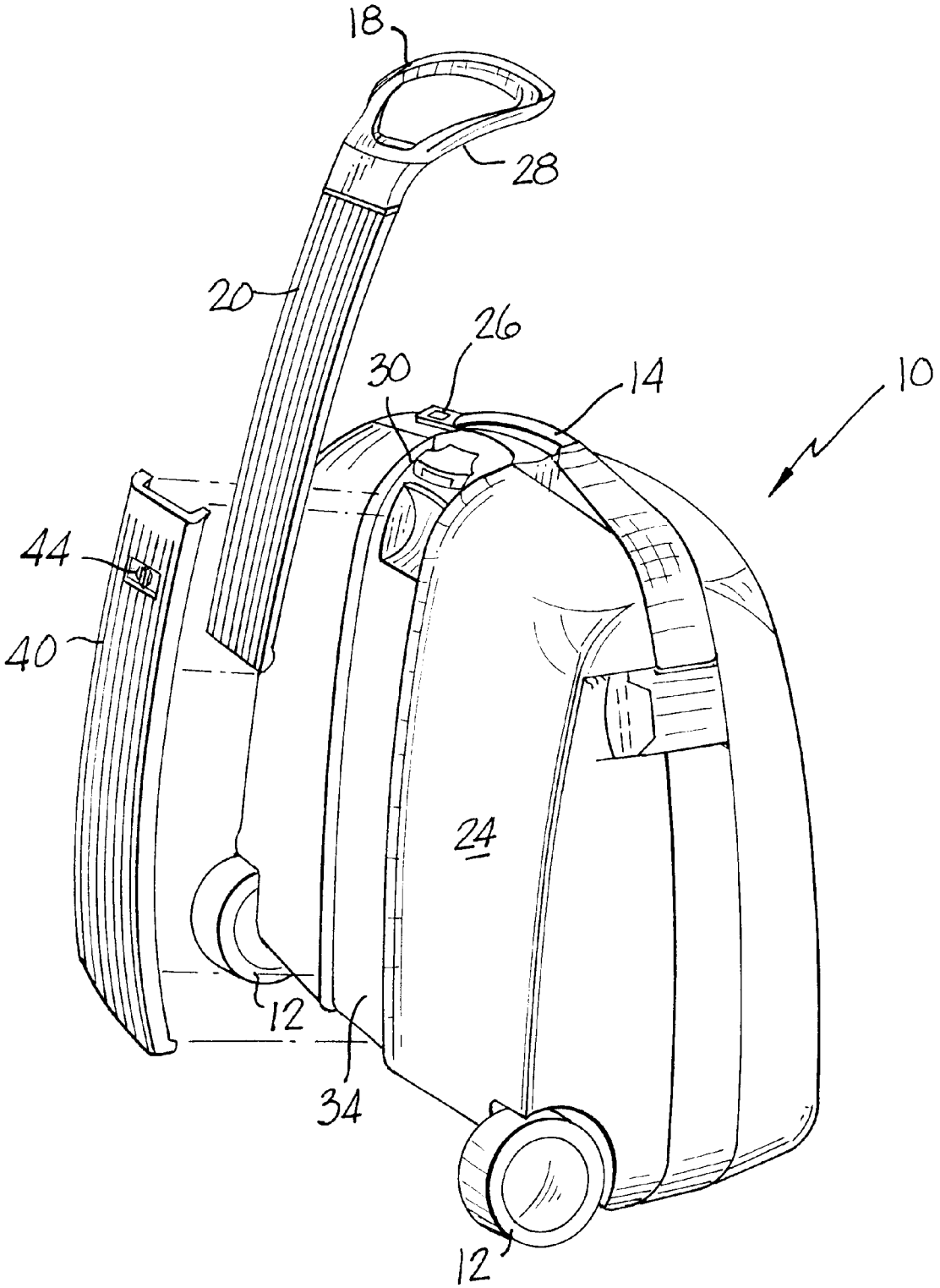
FIG. 6 is an exploded view of the preferred embodiment.
Figure 7:
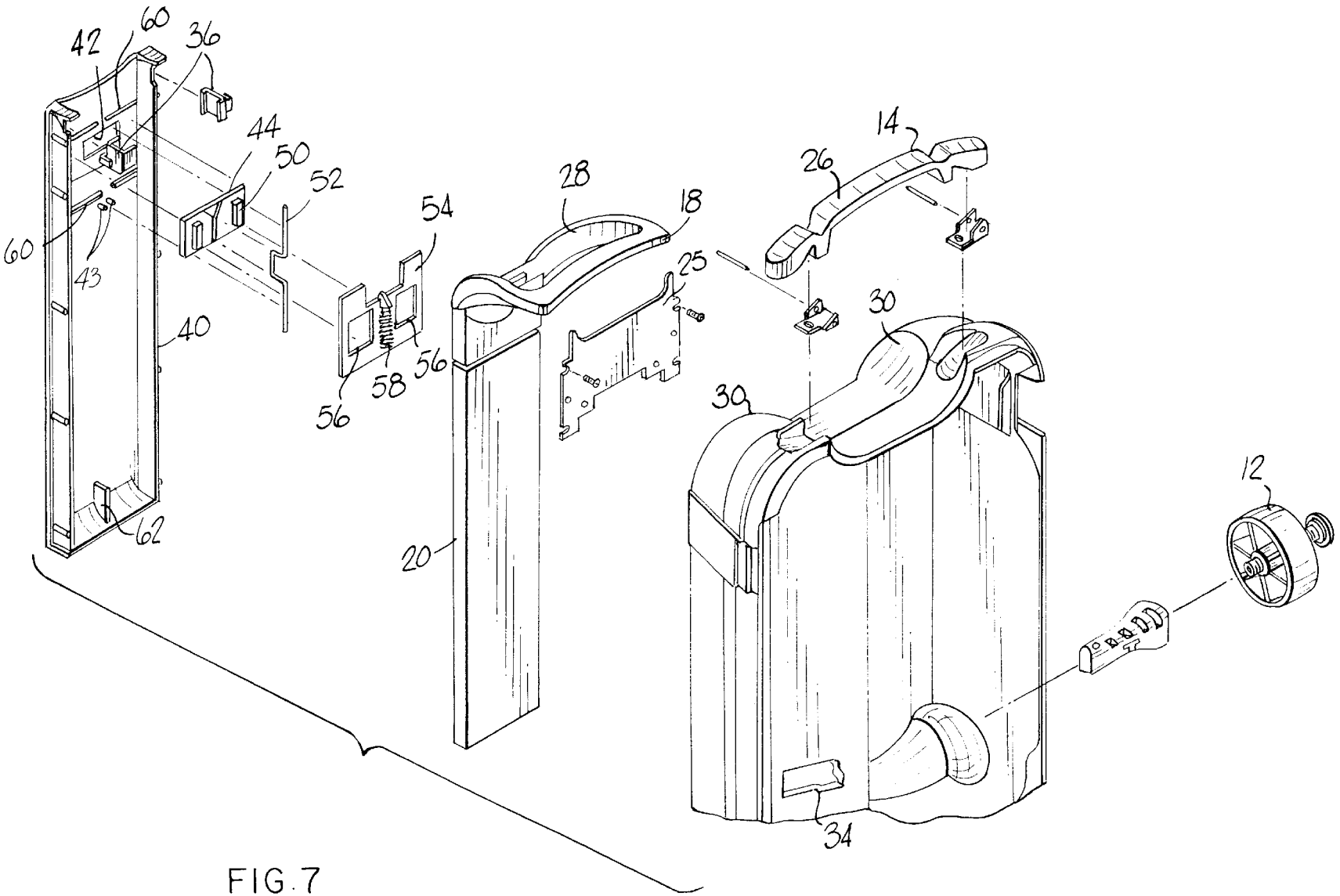
FIG. 7 is a more detailed exploded view showing the construction of the inventive luggage case.

FIGS. 6 and 7 show in greater detail the assembly of the wheel handle arm to the case. Case shell is shown with its associated wheel handle parts in an exploded position. The wheel handle assembly consists of the arm 20 and loop-shaped handle grip 18. As previously discussed, this is attached by screws to the wheel handle itself that as previously discussed, is a one-piece injection molded construction. The slide latch 44 is biased into a central position by a simple, tempered steel spring wire 52 that is gripped at both ends by slots and pins 43 provided in the inner face of the skid plate 40. The protrusions 50 extend through windows 56 in a movable slide member 54. These windows 56 are sized to permit some relative lateral movement by the protrusions on the slide latch yet engage these protrusions to force the slide member to move laterally with the slide. The slide member includes a third protrusion to which is affixed a downwardly directed compression spring 58 centered thereon on the side of the slide member facing the wheel arm. These parts together with anti-friction glides 36 are held together in a sandwich arrangement with attachment plate 25 which normally engages the face (as shown in the figure) of the wheel handle arm 20.

The wheel handle arm 20 itself is a generally flat, rectangular box-like structure, preferably a one-piece injection molded plastic such as fiberglass filled polypropylene. This fits in an outwardly facing groove in the first angled wall of the case shell. The upper end of this groove is shown at its upper end as an indentation in the back wall of the case shell. The skid plate 40, also of injection molded plastic, is attached by screw fasteners (not shown) to trap the wheel handle assembly in this groove. As will be detailed with reference to the other figures, this wheel handle is movable from the position adjacent the case (within this groove) to an extended position by a clever latch and cam follower mechanism. This mechanism described below.

Figure 8:
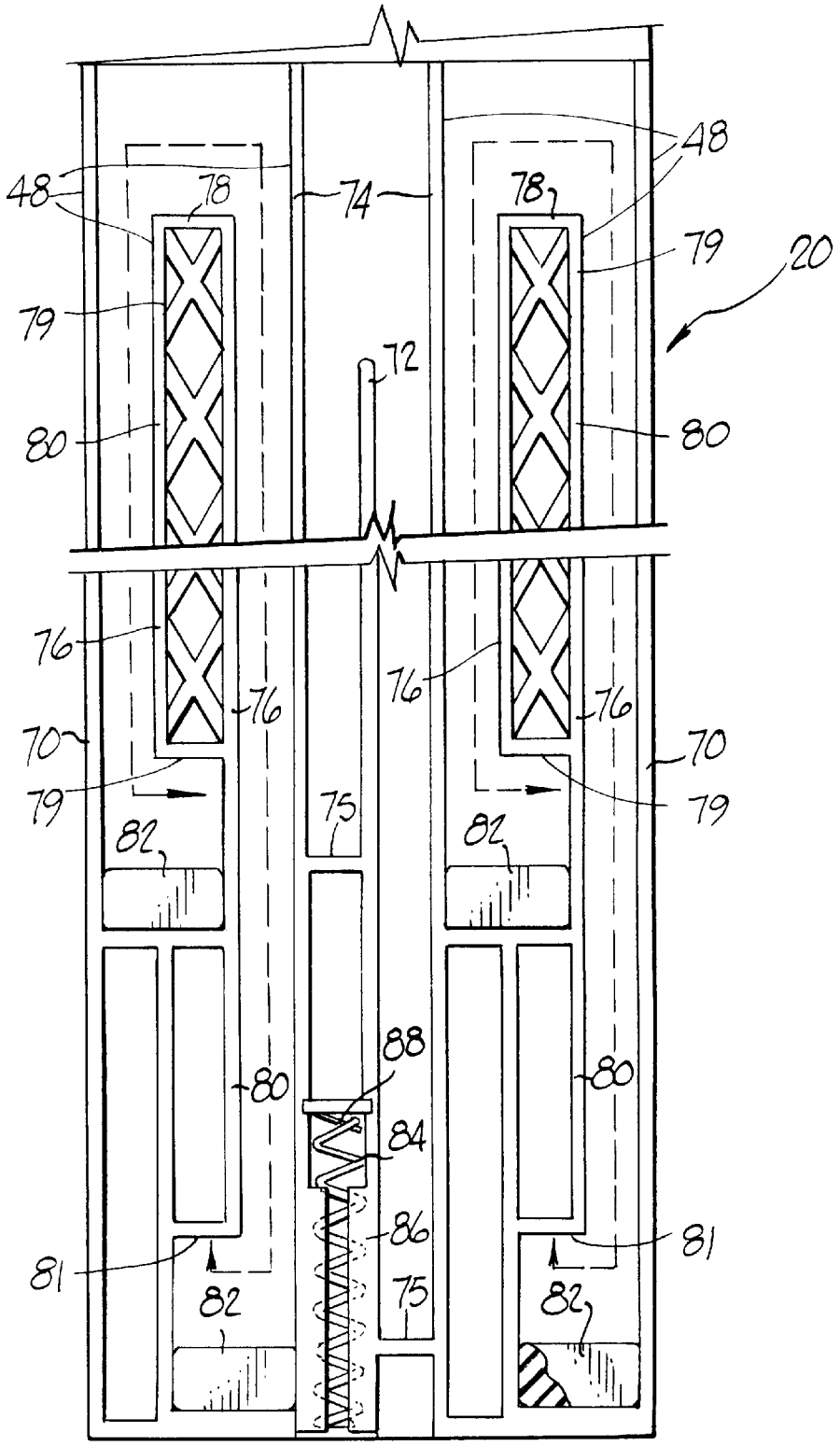
FIG. 8 is a plan view of part of the wheel handle arm.

FIGS. 8 shows the plan view of the face of the wheel handle arm normally facing the skid plate. FIGS. 9A through 9E are similar to FIG. 8 but showing the arm in various positions relative to the latch assembly and portions of the skid plate on the case. This position is indicated by the slide latch and the slide member, these being shown in outline on each view of the various wheel arm positions.

The slide latch and slide member move slightly horizontal relative to the case, and as will be demonstrated, move slightly relative to one another. The position of these moving parts along the length dimension of the skid plate 40 is fixed, since they are sandwiched between the inner surface of the skid plate 40 and the edges of the walls, and are guided by guide rails 60 projecting from the inner surface of the skid plate 40. The top and bottom edges of the latch and slide member ride along these guide rails.

First, a detailed look at the wheel arm 20 is justified. The arm is shown partially broken away. It should be understood that the uppermost end of the arm terminates with a wedge shaped tang (not shown) which fits into a corresponding cavity in the lower most end of the handle loop grip 18. The face of the wheel arm consists of a generally flat surface with many upwardly projecting elongated, generally straight walls or webs 48. Flanking each side edge of the handle are first and second walls 70 which run the full length of the wheel arm. These, along with the other webs and walls, provide a generally stiff wheel arm despite the general thinness of the overall construction. Well to the inside of the first and second walls 70 and flanking center wall 72 are walls 74 which also extend almost the full length of the arm. The pattern of further walls between these walls 70 and 74 form a pair of cam channels which are substantially identical. Such further walls include walls with first surfaces 76. Note these surfaces run along the longitudinal dimension of arm 20. These further walls include enlarged upper and lower end portions 80. These provide laterally extending wall surfaces 78, 79 and 81. Note that these portions form a generally rectangular, elongated box-like structure in which bridging webs, such as those shown in upper portions 80, are integrally molded. These walls serve as both stiffening members and serve as cam surfaces along which protrusions 50 will slide during the extending and retracting of the wheel arm. These walls in aggregate define cam surfaces and tracks or paths along which the first and second protrusions 50 ride as the wheel arm moves relative to the luggage case. These paths are shown as dashed lines in FIG. 8. These paths each have generally inverted U-shapes, with the right legs thereof shorter than the respective left legs. The bottommost ends of these leg path portions are enlarged to allow the protrusions 50 to move laterally a short distance. Rubber blocks 82 occupy the bottom of each of these bottom most portions and absorb the impact of the protrusions as the wheel arm is pulled up to its withdrawn positions.

Center wall 72 together with the inward faces of the walls 74 and associated lateral walls define a narrow inverted U-shaped path along which the compression spring 58 slides on deployment of the wheel arm. The slide member 54 supports this spring as explained above. This spring rides between walls 74 and 72 or between 72 and 74 and engages the horizontal walls 75 at the bottom of the channels defined by those walls depending on the position of the slide member 54.

A second spring 84 is trapped in a slotted retainer 86 by a short, angled web 88 that projects up from the body of the wheel handle. This web engages a turn of the second spring 84 so that it will not fall out even though the bottom of the slotted retainer is open. The upstanding finger 62 (FIG. 7) extending from the lower face of the skid plate 40 is engaged by the lowermost end of the second spring when the wheel arm is in its lowermost or retracted position. In this lowermost position, the finger 62 projects through the open bottom of the slotted retainer 86.

Figure 9A:
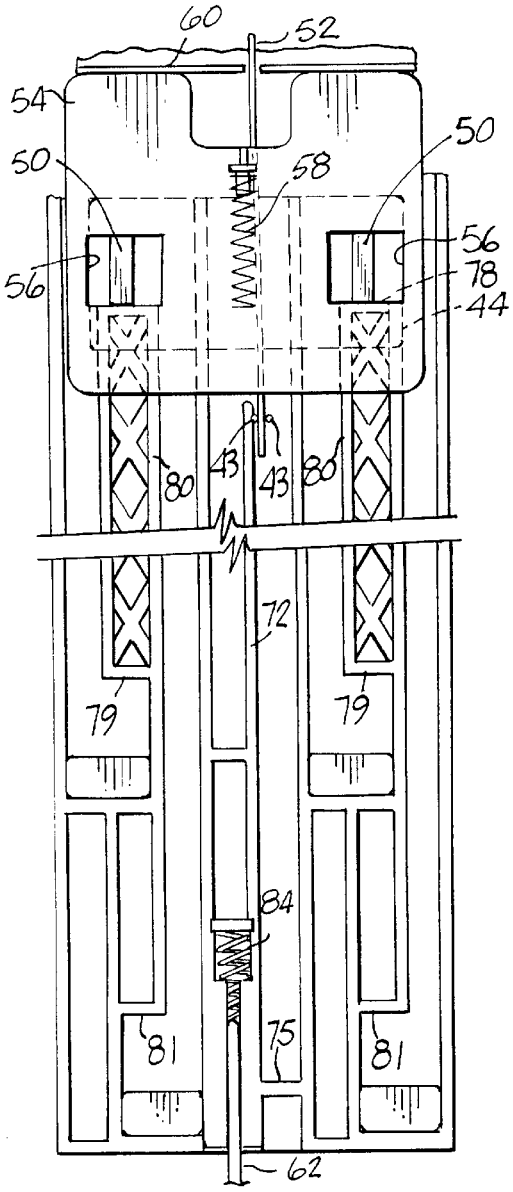
FIGS. 9A through 9E are schematic showings of the operation of the wheel handle arm.

The operation of the wheel handle and its associated latching mechanism will now be discussed. FIG. 9A shows the position of the slide latch 44 and slide member 54 in outline as they would be with the wheel handle in the nested position as shown in FIG. 3. In this position, the wheel handle is in its fully retracted position nested within the carry handle 14 as shown in this position. The slide latch is in its centermost position, urged there by the spring wire 52 carried by the slide latch and fixed to the skid plate 40 as discussed above. Note the first and second protrusions 50 are thus located to engage the upward facing horizontal surfaces 78 of the upper enlarged wall portions 80. The second spring 84 is compressed by the finger 62 protruding from the bottommost edge of the skid plate 40. This spring bias forces the upward facing surfaces 78 of the upper enlarged portions 80 and protrusions 50 against one another, thus holding the wheel handle in place. The compression spring 56 merely sits between the walls 74 in an uncompressed state.

Figure 9B:
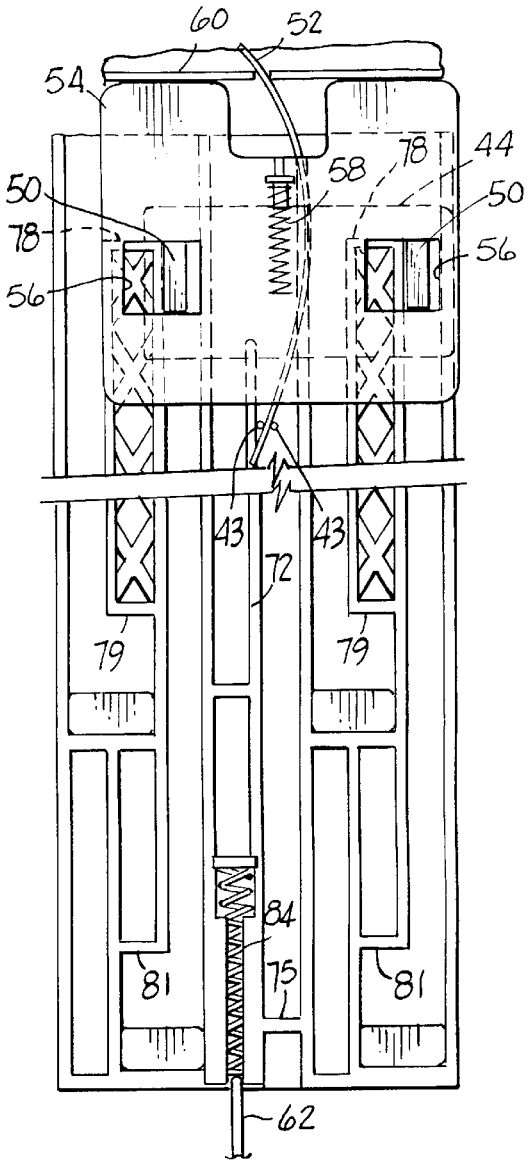

By pressing against the thumb-engageable projection in the manner shown in FIG. 4, the protrusions 50 move to the rightmost position as shown in FIG. 9B. The second spring 84, pushing against the finger 62, lifts the wheel arm 20 about 30 mm. This moves the loop handle grip 18 out of the concavity 26 of the carry handle 14 enough to let the user grasp the loop handle grip to pull the wheel handle to its fully extended position. This slight spring powered movement also places the longer legs of the inverted U-shaped path well up on the protrusions 50 and thus past the surfaces 78. Note while the protrusions project through the window portions of slide member 54, the rightmost position of these protrusions carry the slide member 54 to the right as well, but only the distance defined between one set of walls. This carries the compression spring 58 born by the slide member to be in alignment with the slot to the right of wall 72. As the user pulls the wheel handle up, the first and second protrusions progress down the channel as shown, and the compression spring 58 progress down its cam slot until it encounters the horizontal wall 75 that blocks the bottom of that channel.

Figure 9C:
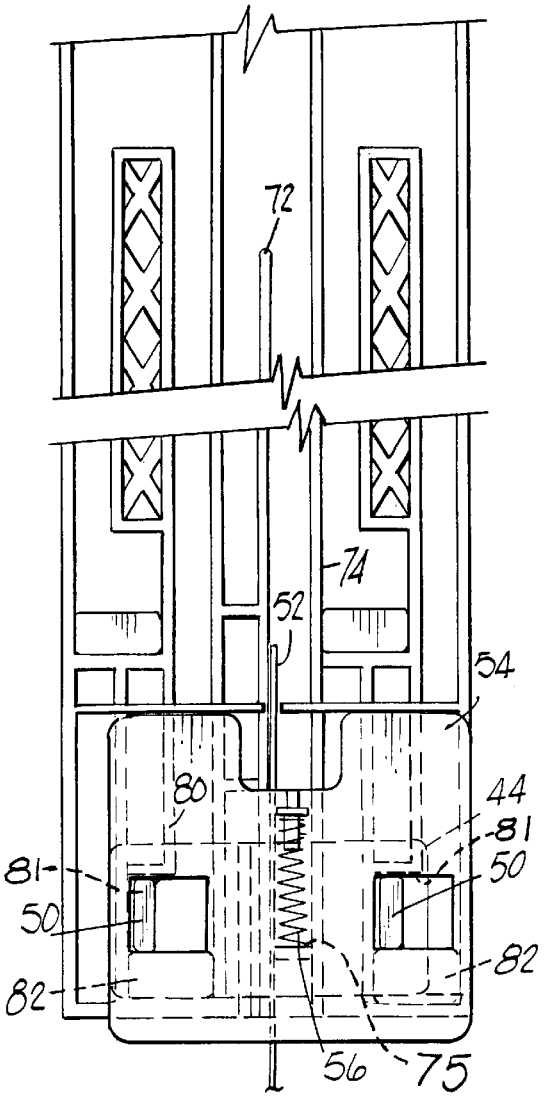

FIG. 9C shows the position with the handle fully extended. The wire spring forces the slide latch toward a center position to bring the upper surface of the protrusions 50 against the downward facing horizontal surfaces 81 of the lower enlarged portions. Note that the compression spring carried by the slide member 58 is now compressed against the horizontal wall 75 as shown. This traps the first and second protrusions against the abutting downward facing surfaces 81 and thus holds the wheel handle in its fully extended position. To retract the handle, the slide button is pushed again toward the right against the bias of the spring wire 52. This permits the first and second protrusions 50 to again traverse the channels in the other direction as the handle drops down on the handle and to the position shown in FIG. 9A with the second spring biased against the finger.

Figure 9D:
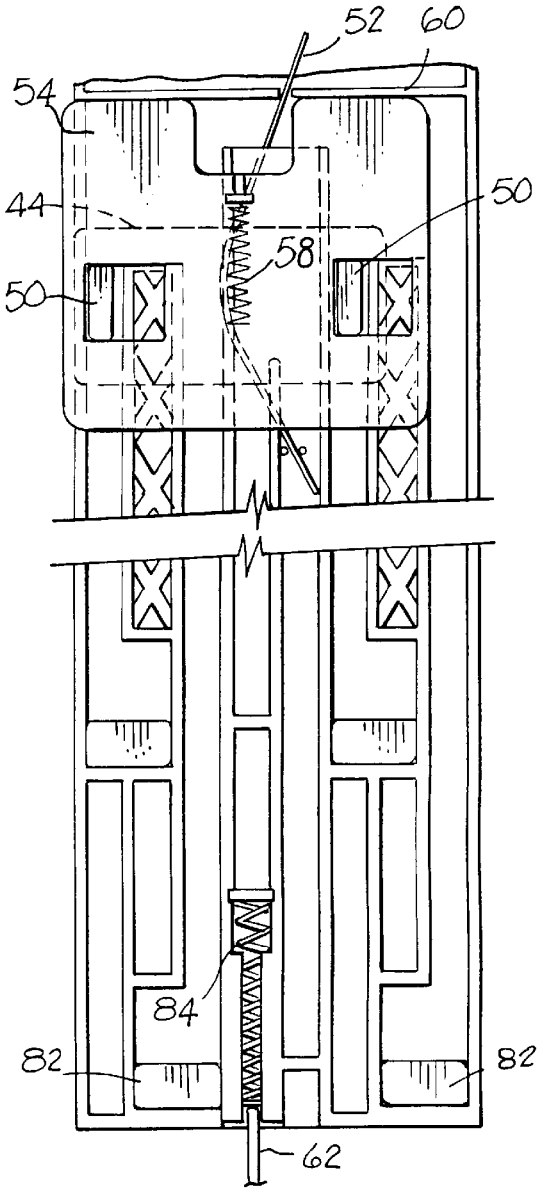
Figure 9E:
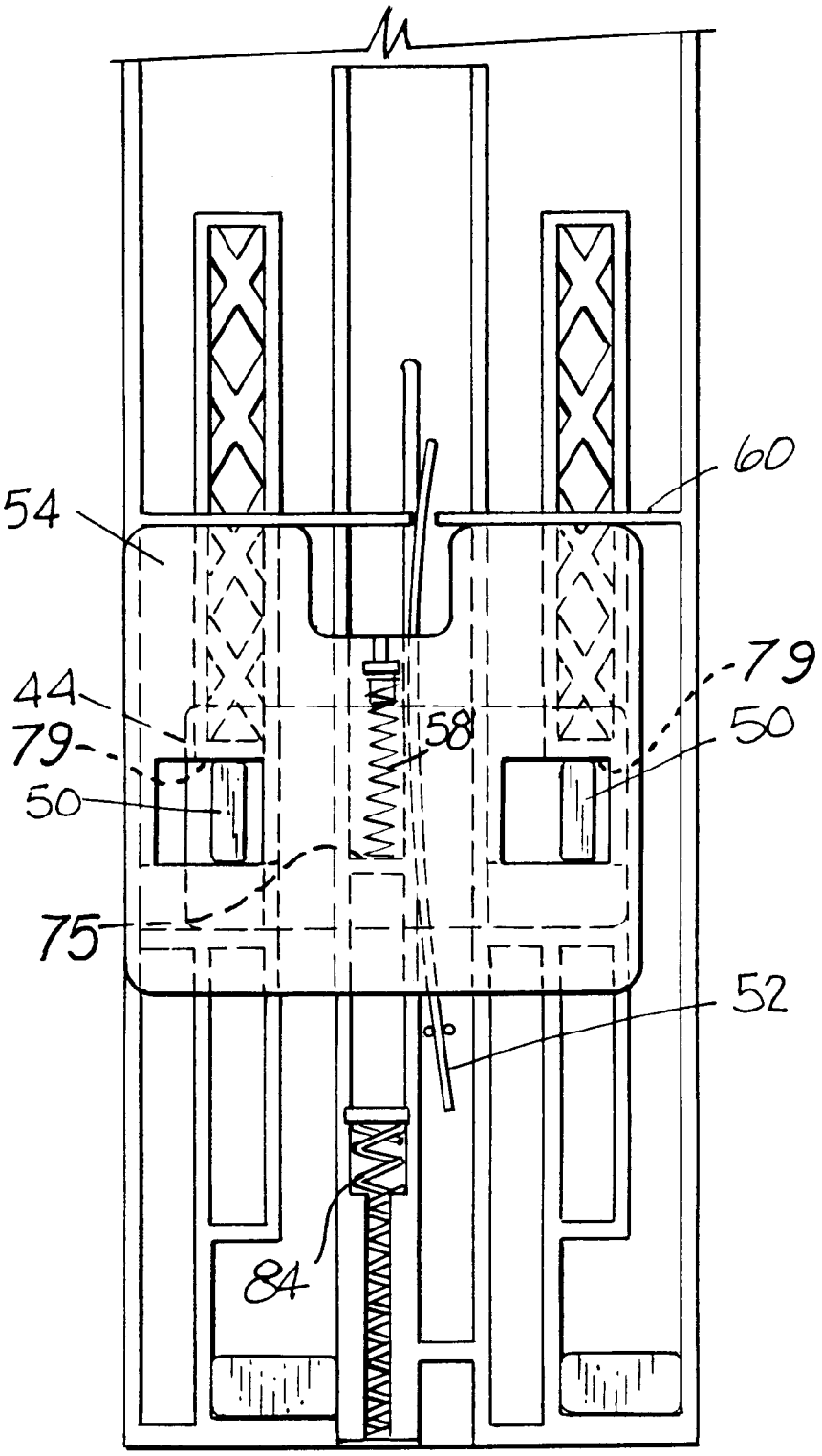

To place the handle in the interim position (as described above where the comfortable handle height of the user or the loading of the case dictates) the user merely pushes against the thumb protrusion to move the first slider in the leftmost position (opposite from that shown in FIG. 9B). This places the first and second protrusions 50 in the channel between upper enlarged portions 80 and the adjacent walls as shown in FIG. 9D. This carries the slide member 54 with its spring 56 one channel width over center wall 72 to place the spring 58 between left wall 74 and center wall 72. Here again, the user pulls up on the handle placing and moving the projections 50 along the channels as shown in an interim position. In this position, the compression spring 58 carried by the slide member engages the upward facing horizontal wall 75 between wall as shown. The slide latch 44, reacting to the biasing pressure of the wire spring, moves to its middle position. The bias of the spring places the protrusions 50 against the downward facing horizontal faces 79 of the upper enlarged portions 80. In this position, the handle would extend to a lesser height from the upper end of the case for the reasons set forth above.

Again, to collapse the handle into its stored position as shown in FIG. 3, the user need only again push the projection 46 to the left. This relieves the spring bias pressure between protrusions 50 and the tangent horizontal surfaces 79, thus forcing the first and second protrusions into the vertical slots as set forth above. The user need only push down on the handle until the first spring engages the finger 62 carried by the skid plate 40, pushing firmly down to nest the wheel handle grip into the carry handle, permitting the wire spring carrying the first slider to the position shown in FIG. 9A. this again locks the wheel handle in its downwardmost or stored position.

Thus, it can be seen that using the projecting walls defining channels in one side of the wheel handle, the three moving parts can control all three desired positions of the wheel handle; a fully downward stored position; a fully extended up position; and an interim position. These positions easily define all functional positions of the handle for use in wheeling, carrying, and storing the case.

We claim:

1. A luggage case including a wheel handle for moving the case on wheels and a carry handle for carrying the luggage case, the wheel handle includes a wheel handle arm mounted along one outside wall of the luggage case, the wheel handle arm has an elongated longitudinal axis, a grip mounted at one end of the wheel arm, the grip including a loop mounted to the wheel handle arm at a substantial angle to the longitudinal axis thereof, which substantial angle positions the grip over the carry handle when the wheel handle is adjacent the outside wall of the case, the carry handle including an upper surface shaped to receive the grip of the wheel handle, whereby the grip of the wheel handle and the upper surface of the carry handle engage one another.

2. A wheeled luggage case having a main packing compartment of generally parallelopiped shape with main front and back walls angling substantially toward one another from a base portion to a top portion, the top portion includes a carry handle with a grip for hand-carrying the luggage case, the back wall includes means for mounting a wheel handle arm in a manner such that the wheel handle arm can be stored adjacent to the back wall and also may be withdrawn from this adjacent relationship with the back wall to a position such that it extends above and over the top portion of the case at a substantial angle, the luggage case further including a wheel handle grip and an extension interconnecting the wheel handle arm and the wheel handle grip, wherein the wheel handle grip is attached at an upper end of the wheel handle arm and the extension is mounted at a substantial angle to the top of the wheel handle arm such that the wheel handle grip is positioned so that the grip and the carry handle nest in one another when the handle arm is in a position adjacent the angled wall of the case.

3. A luggage case as set forth in claim 2 wherein when the wheel handle arm is in a second position such that at least a portion of the wheel handle arm is withdrawn from its adjacent position along the back wall, the wheel handle extends toward the other of the two angled walls.

4. A combination wheel handle arm and a wheeled luggage case, the wheel handle arm having a length dimension wherein the arm is mounted on the case for movement in a direction along its length between a first position adjacent a wall of the luggage case and a second position at least partially withdrawn from the first position for wheeling the case by a user, one of the arm and the wall having at least one cam surface on a surface thereof and the other having a protrusion, the cam surface including at least one channel to receive the protrusion, means operable by the user for controlling the position of this protrusion in the channel, the channel includes at least a first surface and a second surface for engaging the protrusion, the first surface oriented in the direction of the length of the arm such that the protrusion can move along the first surface whereby the wheel handle arm can thus be withdrawn from its adjacent position, and the second surface of the channel is oriented relative to the direction of the length of the arm wherein the protrusion is engaged by the second surface of the channel such that the wheel handle arm is blocked from moving from the first position adjacent the case, wherein the channel further including a third surface for engaging the protrusion, the third surface is oriented relative to the direction of the length of the arm such that the wheel handle arm can be locked into the second position, and wherein the luggage case has an upper surface that extends from the wall of the case to a carry handle positioned approximate a central location on the upper surface, a handle grip for the user to manually engage is attached to an upper end of the arm for wheeling the luggage case, the handle grip has a generally loop shape, the handle grip normally extending at a substantial angle to the arm whereby the handle grip projects over a top surface of the case, the carry handle has a generally concave upper surface to nest with a lower surface of the handle grip when the arm is in the first position.

5. A combination wheel handle arm and wheeled luggage case as set forth in claim 4 wherein the arm is a substantially one-piece construction.

6. A combination wheel handle arm and wheeled luggage case as set forth in claim 4 wherein the protrusion is carried by the wall of the luggage case and the cam surface is carried by the arm.

7. A combination wheel handle arm and wheeled luggage case as set forth in claim 4 wherein the arm has a generally flat, rectangular shape in cross section having at least a major face, the major face including several upstanding walls, the channel being defined between at least some of the upstanding walls, whereby the upstanding walls help make the wheel arm stiffer.

8. A combination wheel handle arm and wheeled luggage case as set forth in claim 4 wherein one of the arm and the wall includes two channels, and the other of the arm and the wall includes two protrusions, one of the protrusions engaging one of the channels, and the other of the protrusions engaging the other of the channels.

9. A combination wheel handle arm and wheeled luggage case as set forth in claim 4 wherein the protrusion is carried by a slide latch, the wall of the luggage case has an aperture approximate to the slide latch, the slide latch includes a projection that extends at least part way through the aperture, whereby the user can manually engage the projection and position the protrusion relative to the first and second surfaces.

* * * * *